United States Patent [19]

Suenens et al.

[11] Patent Number: 5,016,305

[45] Date of Patent: May 21, 1991

[54] INNERSPRING CONSTRUCTION FOR MATTRESSES, CUSHIONS, AND THE LIKE AND PROCESS FOR MANUFACTURING SAID CONSTRUCTION

[75] Inventors: Albert J. Suenens; Marcel Ghysels, both of St.-P.-Leeuw, Belgium

[73] Assignee: NV B'Linea, Beersel-Lot, Belgium

[21] Appl. No.: 484,801

[22] Filed: Feb. 26, 1990

[30] Foreign Application Priority Data

Oct. 5, 1989 [BE] Belgium ..... 08901067

[51] Int. Cl.[5] ..... A47C 27/04

[52] U.S. Cl. ..... 5/477; 5/475

[58] Field of Search ..... 5/475, 477, 480

[56] References Cited

U.S. PATENT DOCUMENTS 2,296,807 9/1942 Cavaler ..... 5/477
3,869,739 3/1975 Klein ..... 5/477
4,578,834 4/1986 Stumpf ..... 5/477
4,907,309 3/1990 Breckle ..... 5/477

FOREIGN PATENT DOCUMENTS 0154076 11/1985 European Pat. Off. .

*Primary Examiner*—Michael F. Trettel
*Attorney, Agent, or Firm*—Cushman, Darby & Cushman

[57] ABSTRACT

An innerspring construction for mattresses, cushions and the like, with jackets encasing separate coil springs which are arranged in a parallel fashion with respect to their longitudinal axes, the jackets being made out of oblong strips of cover which have been adhered side to side, the adhesive consisting of an relatively flexible coating which is spread in a substantially continuous manner over the contact surface of at least certain adjacent jackets of adjacent strings, in such a way that deformation of both said fabric and the adhered strings remain possible in the direction of the longitudinal axes of the springs.

9 Claims, 3 Drawing Sheets

INNERSPRING CONSTRUCTION FOR MATTRESSES, CUSHIONS, AND THE LIKE AND PROCESS FOR MANUFACTURING SAID CONSTRUCTION

BACKGROUND OF THE INVENTION

1. Field of the Invention

The invention is relating to an innerspring construtcion for mattresses, cushions and the like, including separately pocketed coil springs which are placed parallel to one another according to their longitudinal axis, the pockets being manufactured out of oblong strips of fabric cover, which are fixed by means of glue to each other, whereby the longitudinal axis of the separated coil springs are arranged in a transverse fashion with respect to the longitudinal axis of the cover, the springs being encased in these close-fitting pockets.

2. Description of the Prior Art

Such an innerspring construction has been described in the European Patent Application No. 0154076. According to this European Patent Application two adjoining strips of pocketed springs are connected by means of an adhesive which is applied in a series of dots or strips. The reason being, on one hand, to minimize use and consumption of adhesive and, on the other hand, to make sure that deformation along the axes of the springs remains possible.

As the adhesive is to be found only on a limited part of adjoining tangential surfaces of two spring covers, important forces are concentrated at the place of the linking dots or strips of adhesive, and hence attachments are at risk of loosening. If such an attachment breaks in a certain spot, the load is transmitted to the adjoining connections, resulting in an even higher load and a greater chance of breakage. The main object of the present invention is to remedy these advantages in a simple and economical way.

SUMMARY OF THE INVENTION

To this aim the above mentioned adhesive consists of a relatively flexible coating which is spread in a substantially continuous manner on the larger part of the adjoining tangential surfaces on at least certain adjacent jackets of adjoining covers in such a way that deformation of both the adhesive coating and the jackets stuck together remain possible along the longitudinal axis of the springs. It is appropriate that the layer of adhesive covers almost the whole surface in contact between two jackets of adjacent strings stuck together.

In a more specific embodiment of the invention the covers of adjoining strings are stuck together only every two or three jackets.

The field of the invention also relates to a method for assembling innerspring constructions which is characterized by the fact that the coating is sprayed onto the cover.

BRIEF DESCRIPTION OF THE DRAWING

Particulars features and advantages will become clear after studying the description of several specific embodiments of innerspring constructions according to the invention and of a method for manufacturing the innerspring construction. The description is merely meant as an illustration of the invention and therefore it does not limit the scope thereof. Numbers used hereafter refer to the accompanying drawings.

Figure 1:
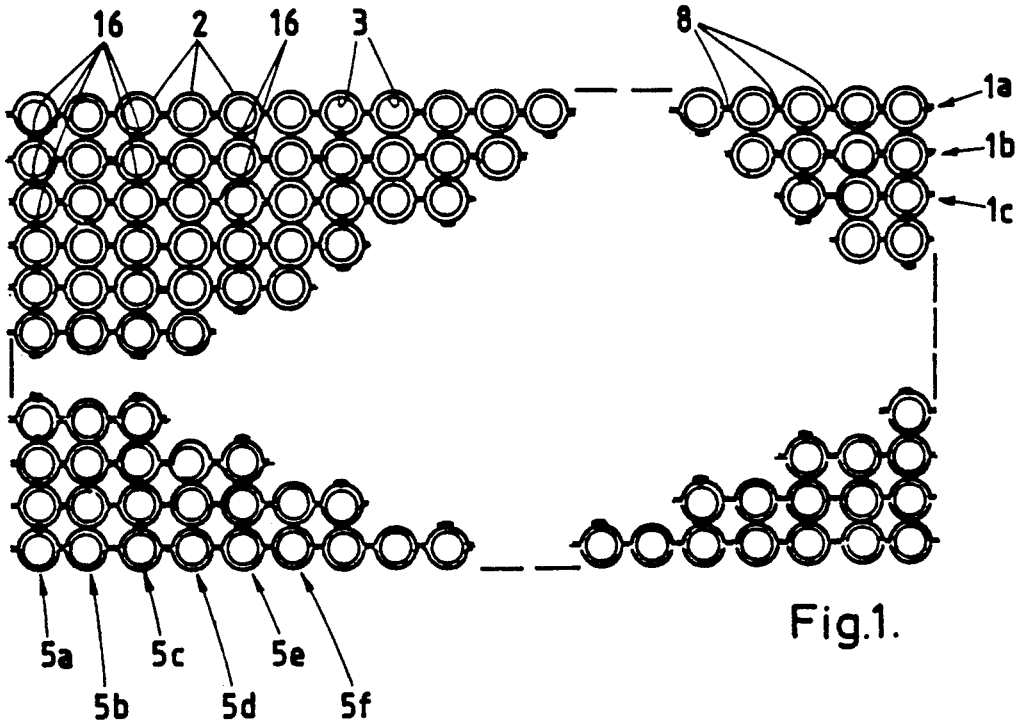
FIG. 1 is a top plan view of the innerspring construction according to the first embodiment of the invention, FIGS. 2 through 4 provide analogous representations of other embodiments of the innerspring construction according to the invention, FIG. 5 provides part of a section along line V—V (FIG. 3), but on a large scale.

References in all figures are to the same or analogous parts.

DETAILED DESCRIPTION OF THE PRESENTLY PREFERRED EXEMPLARY EMBODIMENT

According to the invention, the innerspring construction for matresses, cushions and the like consists of strings of pocketed coil springs which are arranged in such a way that their longitudinal axes are parallel to one another. Hence springs are connected, though they remain sufficiently independent so that compressibility along their axis is allowed for. Jackets are made out of fabric cover in which springs are arranged adjacently, their longitudinal axis being set perpendicularly to the longitudinal axis of the fabric cover. The cover is preferably made from an oblong strip of weldable material which has been folded right in the middle according to its longitudinal axis. Near the folded longitudinal edges the cover is welded and at regular distances the cover is also joined transversely, forming successive jackets encasing said springs.

The fabric used for the cover is preferably made from a tissue of thermoplastic fiber.

Such a cover incorporating springs is known by itself and described in, e.g., the European Patent Application No. 0 154 076.

It is obvious that other fabric might be used as well, more particularly fabric which cannot be welded, such as cotton. In the latter case jackets can be stitched or glued. It would be feasible to combine several techniques depending on the cover fabric and the available equipment.

However, as the invention is not really concerned with these strings of pocketed springs, it is not necessary to go into more detail here.

The invention consists of an innerspring construction in which two adjoining strings of mutually connected resilient jackets encasing springs are joined by means of a relatively flexible coating of adhesive which has been spread substantially continuously over a great part of the contact surface of at least certain adjacent string jackets. Due to the glue's flexibility, deformation of the adhered covers remains possible at contact surface level.

The adhesive coating is applied to nearly the whole contact surface, thus tension and stress ensuing from deformation of the innerspring construction in jackets stuck together is spread almost evenly over the relatively large surfaces in contact. Hence, attachment is intense such that is suffices for most applications to stick only every other two or three jackets together. This way independence of springs with respect to one another is furthered, without deteriorating the construction's necessary coherence and relative rigidity.

It has been established that very good results are obtained if the flexible coating of adhesive consists of plastic adhesive glue, such as the kind of hot melt adhesive produced by the National Starch & Chemical Company and sold under the trademark of "INSTARVELD H 362".

Although, according to the invention, the innerspring construction is not limited to a specific type of coil spring, i.e. in principle, it is true that usually barrel-shaped springs are chosen, thus limiting the tangential surface between adjoining pocketed springs to half or two thirds of the total height of the coil spring when it is not axially loaded.

Notwithstanding that it may be useful, in certain cases, to spread the adhesive coating over nearly the center coil spring height. For when two adjacent springs are compressed, the contact surface relates to nearly the entire height of the springs. Compression of the springs will lead to more cover surface in contact. Hence if, as is allowed for by the invention, a glue is used which remains adhesive throughout, an attachment will emerge on the increased contact surface when pressure is applied. So attachment between jackets is furthered at a time when springs are loaded, which may be of great use in certain cases. However, even if the glue does not remain adhesive throughout, the coating which was spread round the contact surface will consolidate parts of the jackets which are rubbed when the innerspring construction is used.

Figure 5:
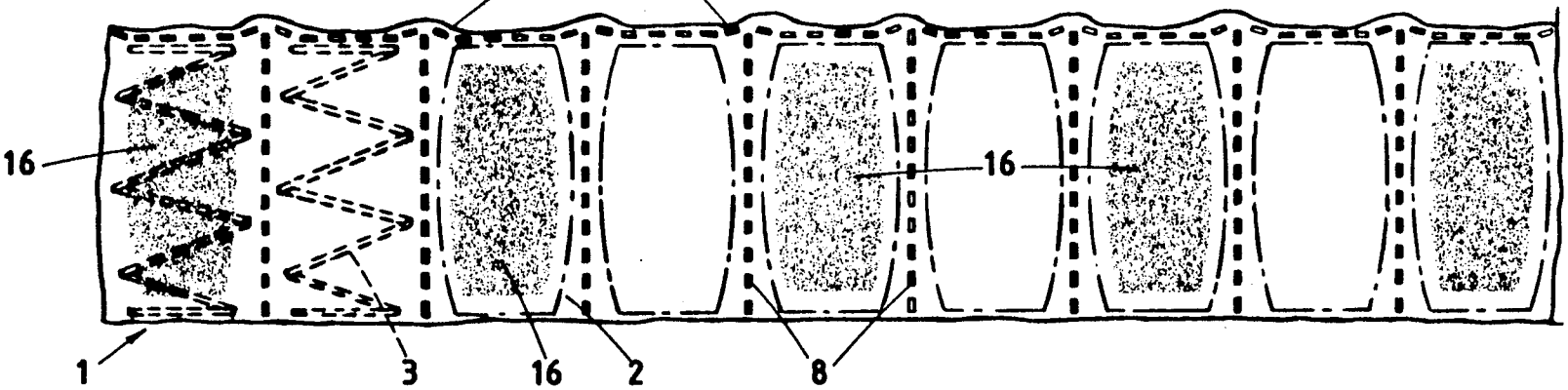

FIG. 1 outlines a first embodiment of an innerspring construction, consisting of a successive series of parallel strings 1*a*, 1*b*, 1*c*, etc., of jackets 2 encasing coil springs 3. Pockets or jackets are made, as mentioned above, by means of oblong strips of fabric cover 4 (FIG. 5). The relative arrangement of the springs 3 encased in the jackets 2 is such that they are arranged in a square with respect to one another. Further, it should be noted that jackets of a particular string, e.g. 1*a*, are joined by means of adhesive coating 16 only every other jacket to the corresponding jacket of an adjoining string.

Hence one obtains alternately rows of jackets which are joined transversely onto the axes of strings 1*a*, 1*b*, etc., i.e. the rows referred to as 5*a*, 5*c*, 5*e*, etc., while the intermediate rows are referred to as 5*b*, 5*d*, 5*f*, etc. are clear and free with respect to one another.

Figure 2:
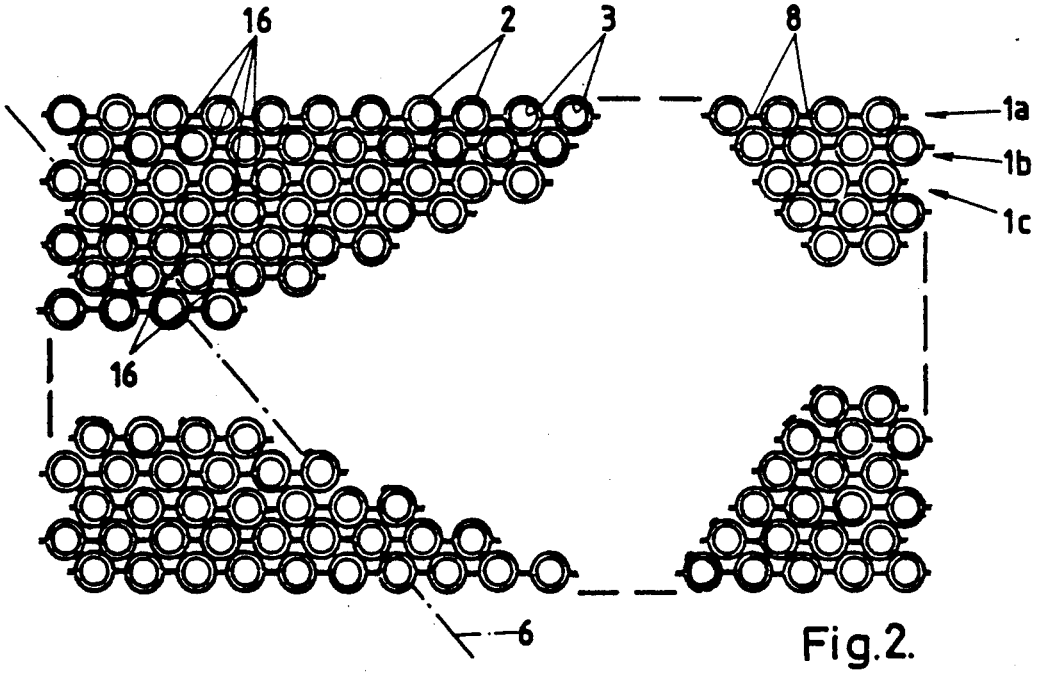

FIG. 2 shows a second embodiment of the innerspring construction according to the invention, which differs from the first embodiment in that the pocketed springs of a particular string, e.g. 1*a*, and those of the adjacent string 1*b* are arranged in a quincunx pattern. Thus in this case the number of springs on a surface of innerspring construction is increased in comparison to the first case in which springs are arranged in a square, as shown in FIG. 1.

Moreover, a particular jacket will have contact surfaces with four adjoining pockets. Hence it is possible to create stronger links between different pocketed coil springs. If need be, it suffices to coat the four contact surfaces with an adhesive covering most of the surface.

Yet it is possible to get a sufficiently strong innerspring construction by adhering only every other jacket to a jacket of the adjoining string, as is shown in the FIG. 1 embodiment.

On this way slanting parallel rows of adhered pockets are obtained over different strings of pocketed coil springs, e.g. FIG. 2 shows a dotted line 6 which runs through adhered contact surfaces 16 of successive strings 1*a*, 1*b*, etc..

Figure 3:
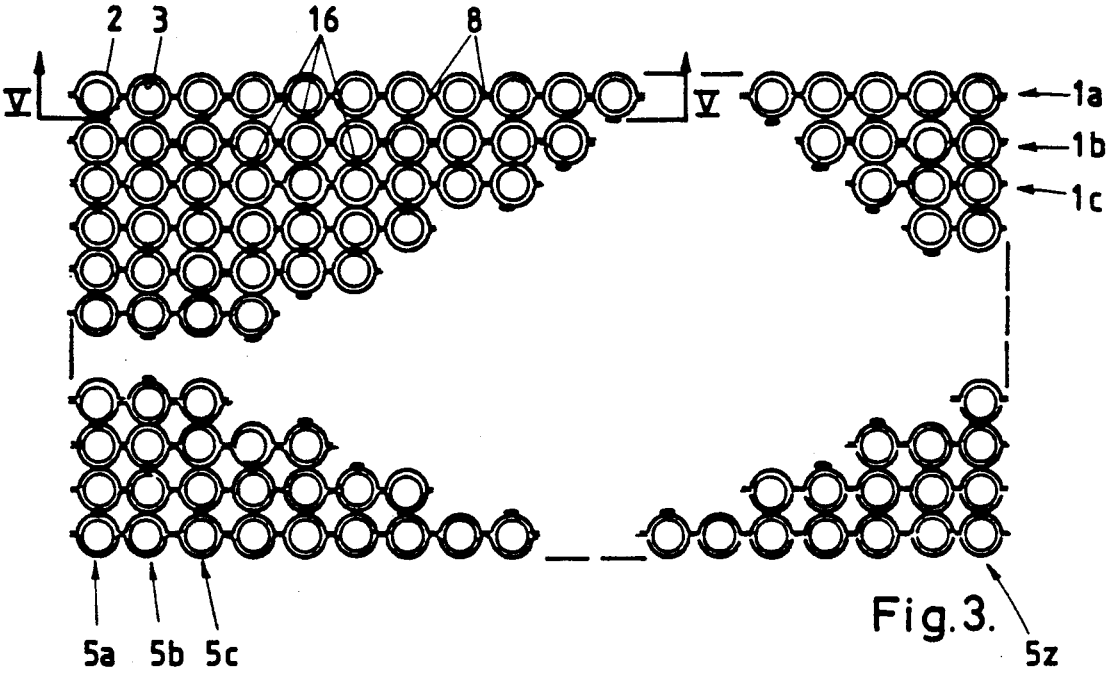

In accordance with the invention, FIG. 3 shows a third embodiment of an innerspring construction, again arranged in a square.

The difference between the third embodiment and the one proposed in FIG. 1 is that the joining of jackets of adjacent strings occurs in a quincunx pattern. Hence, one finds alternately two adjacent jackets which are adhered and two which are not in every row 5*a*, 5*b*, etc., perpendicular on the axes of the strings 1*a*, 1*b*, etc.. The adhesive is thus spread in a homogenous fashion over the whole innerspring construction.

Figure 4:
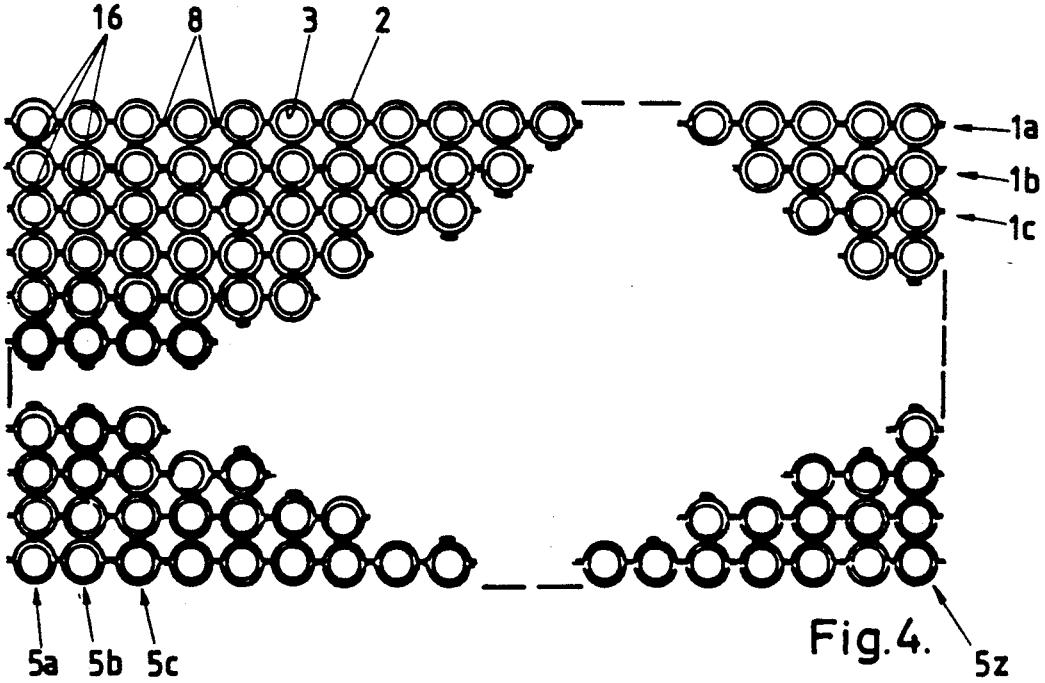

The fourth embodiment of the innerspring construction according to the invention, as presented in FIG. 4, differs from the above mentioned embodiment in that the jackets of the outermost row 5*a*, etc., are all adhered, which is not the case in the embodiment represented in FIG. 3, since in the latter case adhesive is provided for only every other jacket. This is quite an improvement as the outermost rows are of prime importance to the firmness and sturdiness of an innerspring construction.

FIG. 5 which provides a section along V—V of FIG. 3, but on a larger scale, clearly shows a particular embodiment of a string 1 with successive jackets 2 encasing barrel-shaped springs 3 which are arranged parallel to one another along their longitudinal axes.

In this particular embodiment, a string 1 is made out of a cover 4 of thermoplastic fiber, such as polyethylene or polypropylene fiber, as described above. Jackets 2 are shaped in this cover fabric by means of ultrasonic welding. Thus the cover 4 consists of an oblong piece of resilient fabric which has been folded double along its longitudinal axis and which has been stuck together by means of a weld 7 near the folded longitudinal edges; transverse welds 8 are made between two successive springs. Every other pocket is coated with an adhesive 16 which covers nearly the entire height and width of the jacket.

When manufacturing innerspring constructions according to the ivention, one starts off with a string 1 of jackets 2 encasing springs 3, which may have been cut already to the desired length. Preferably, said string is made of the above mentioned cover 4.

In the first stage an adhesive is sprayed onto at least one of the longitudinal sides of the first cover strip, cut to the proper length and containing separate springs. In this way a homogeneous adhesive thin coating is spread on a surface as large as possible, either on every corresponding side of a jacket 2, or on every other two or three jackets. In a second stage, the adhesive coating is pressed to one of the sides of a second string of springs, in such a manner that the springs of these said strings are arranged in a square or in a quincunx pattern. The cycle of adhering and squeezing strings together is repeated with consecutive strings of pocketed springs until an innerspring construction of desired size and arrangement of adjacent covers is obtained.

Figure 7:
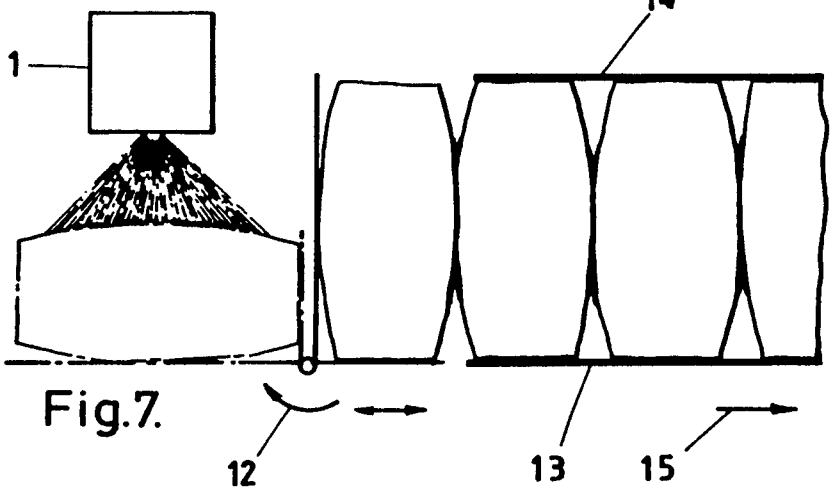
FIGS. 6 and 7 are diagrams of the method for manufacturing innerspring constructions according to the invention.
Figure 6:
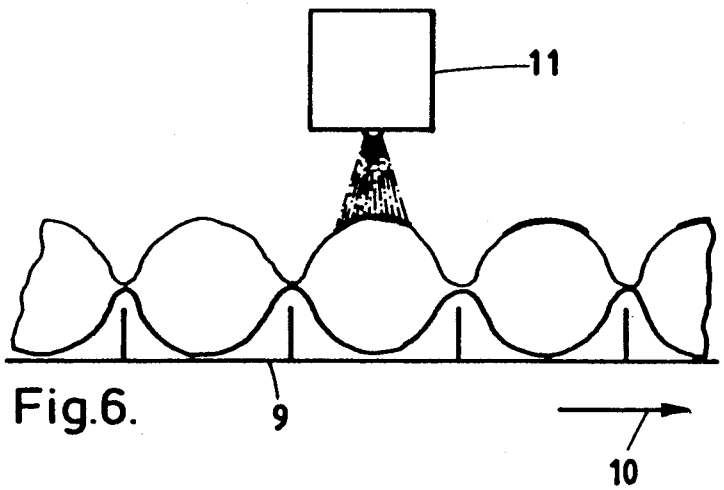

Preferably, the general manufacturing method, described in FIGS. 6 and 7, is as follows.

A string 1 of successive pocketed 2 springs 3 is put on a horizontal conveyor 9, such that the axes of the springs are horizontal and transverse on the direction of movement 10 of the conveyor. The conveyor passes for a certain interval underneath a fixed applicator 11 which sprays a coat of adhesive—either continuously or discontinuously—onto at least the central part of a pocket side while the conveyor is moving. Spraying can be programmed such that only every other jacket is coated with adhesive.

In the next stage, as is illustrated in FIG. 7, the string of coated jackets is tilted over 90°, as is indicated by arrow 12. Hence, the springs and their axes get a vertical position. Now the string is pressed to a similar string of pocketed springs which may have been adhered to another similar string already.

The cycle is repeated until an innerspring construction of desired size is obtained.

Strings of pocketed springs which have already been joined are slightly compressed between two plates 13 and 14 and are pushed forward, as indicated by arrow 15, by a newly arrived coating string. Although the above mentioned method is preferred for manufacturing innerspring constructions according to the invention, the scope of the invention is by no means limited to the use of this method; a movable applicator 11 might be used which passes over a fixed string of pocketed springs which is either in horizontal or in vertical position.

What is claimed is:

1. An innerspring construction for at least mattresses and cushions comprising:

strings of jackets encasing separate coil springs, said springs being arranged in a parallel fashion according to longitudinal axes of said springs, wherein the jackets are manufactured from oblong strips of material which have been adhered at contact surfaces by means of an adhesive such that separate coil springs are arranged so that each of their longitudinal axes is substantially transverse to longitudinal axes of the strips of material, wherein the coil springs are put in said jackets, said jackets being close-fitting, and wherein said adhesive consists of a relatively flexible coating of adhesive which is spread substantially continuously over a main part of a contact surface between at least certain adjacent jackets of adjoining strips of material, in such a way that deformation of both the coating and the covers stuck together is possible in a direction according to the longitudinal axes of said coil springs.

2. An innerspring construction as defined in claim 1, wherein said coating covers nearly the whole contact surface of two jackets of adjoining strips of material stuck together.

3. An innerspring construction as defined in claim 1, wherein said coating consists of a glue which has lasting adhesive qualities.

4. An innerspring construction as defined in claim 1, wherein said flexible coating consists of plastic hot melt adhesive.

5. An innerspring construction as defined in claim 1, wherein the strips of material encasing coil springs are arranged in parallel rows to one another.

6. An innerspring construction as defined in claim 5, wherein the jackets of parallel strips of material are arranged in a sqaure pattern.

7. An innerspring construction as defined in claim 5, wherein the jackets of two successive strips of material are arranged in a quincunx pattern.

8. An innerspring construction as defined in claim 1, wherein adjoining strips of material are adhered only every two or three jackets.

9. An innerspring construction as defined in claim 1, wherein said coil springs are barrel-shaped.

* * * * *